US009182130B2

(12) United States Patent
Abele et al.

(10) Patent No.: US 9,182,130 B2
(45) Date of Patent: Nov. 10, 2015

(54) RETRACTABLE VENTILATION SYSTEM

(75) Inventors: Dominik Abele, Linkenheim (DE); Marc Federmann, Sternenfels (DE)

(73) Assignee: BSH Hausgeraete GmbH, Munich (DE)

( * ) Notice: Subject to any disclaimer, the term of this patent is extended or adjusted under 35 U.S.C. 154(b) by 676 days.

(21) Appl. No.: 13/592,458

(22) Filed: Aug. 23, 2012

(65) Prior Publication Data

US 2013/0061843 A1 Mar. 14, 2013

(30) Foreign Application Priority Data

Sep. 8, 2011 (DE) ..... 10 2011 082 360

(51) Int. Cl.

| | |
|---|---|
| ***H02K 7/12*** | (2006.01) |
| ***H02P 3/02*** | (2006.01) |
| ***F24C 15/20*** | (2006.01) |
| ***B04B 13/00*** | (2006.01) |

(52) U.S. Cl.

CPC ..... *F24C 15/20* (2013.01); *B04B 13/003* (2013.01); *F24C 15/2078* (2013.01)

(58) Field of Classification Search

CPC ..... F24C 15/20; B04B 13/003
USPC ..... 318/3
See application file for complete search history.

(56) References Cited

U.S. PATENT DOCUMENTS

| | | | | |
|---|---|---|---|---|
| 4,535,601 | A * | 8/1985 | Newell et al. | 62/171 |
| 2002/0029696 | A1 | 3/2002 | Grimm et al. | |
| 2007/0295324 | A1 * | 12/2007 | Feisthammel et al. | 126/299 D |

FOREIGN PATENT DOCUMENTS

DE 19814000 A1 9/1999

OTHER PUBLICATIONS

European Search Report EP 12 18 2354.

* cited by examiner

*Primary Examiner* — Eduardo Colon Santana
*Assistant Examiner* — Gabriel Agared
(74) *Attorney, Agent, or Firm* — James E. Howard; Andre Pallapies

(57) ABSTRACT

A retractable ventilation system for a household appliance includes a lifting motor for moving the ventilation system in two opposing directions, and a switch controlling movement of the lifting motor. A first actuation of the switch moves the ventilation system in a first (or preferred) of the two directions, and a second actuation of the switch moves the ventilation system in a second direction opposing the first direction. Furthermore, a household appliance includes an extractor hood, a cooking appliance or a combination thereof, and at least one of the proposed retractable ventilation systems. A method for operating the retractable ventilation system is also described.

21 Claims, 1 Drawing Sheet

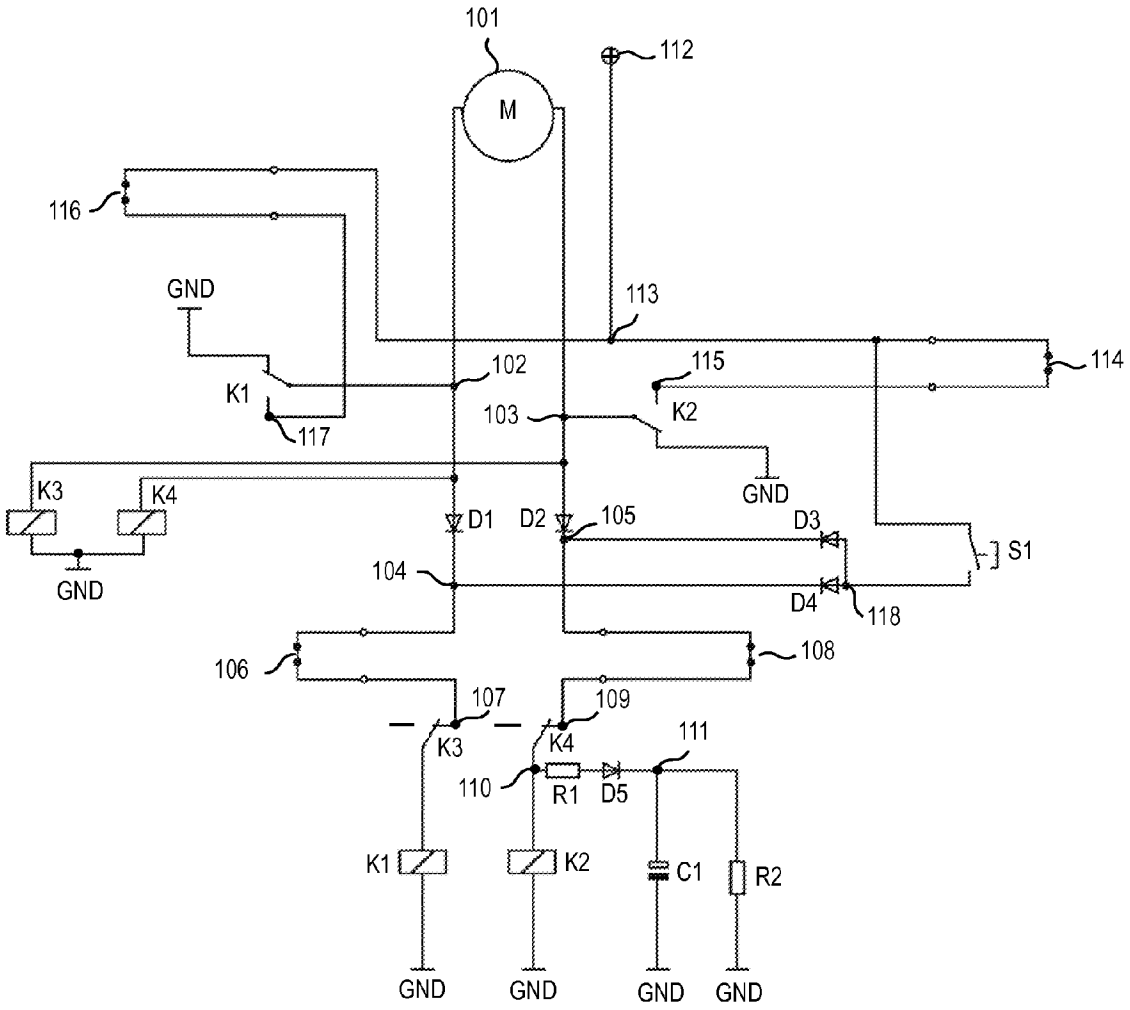
101
M
112
113
114
115
K2
GND
103
102
K1
117
116
GND
K4
K3
GND
S1
118
D3
D4
105
D2
D1
104
108
109
K4
R1
D5
110
107
K3
106
111
C1
R2
K2
K1
GND
GND
GND
GND
GND

RETRACTABLE VENTILATION SYSTEM

BACKGROUND OF THE INVENTION

The invention relates to a retractable ventilation system for a household appliance as well as a household appliance having at least one such ventilation system. The invention also relates to a method for operating the ventilation system.

Retractable tabletop ventilation systems are known which work like extractor hoods but can be recessed into a surface (e.g. a kitchen worktop or a table). Typically retractable tabletop ventilation systems are disposed in the immediate vicinity of a cooktop, from the operator's perspective generally behind the cooktop. Such retractable tabletop ventilation systems are frequently also referred to as downdraft extractors. Thus it is possible that e.g. during cooking the retractable tabletop ventilation system is extended and then retracted again as soon as it is no longer required. The retractable tabletop ventilation system can for example comprise a suction housing or an air intake, either of which can be extended for suction.

It is known for the retractable tabletop ventilation system to be operated with a single button, which when operated once extends the system and when operated afresh retracts it again. Certain safety criteria have to be satisfied here, so that the possibility of trapping e.g. a hand or a finger in the retractable tabletop ventilation system when it is being retracted is effectively prevented.

In this respect it is known for operation to be implemented by means of the single button incorporating safety circuits using microcontrollers or integrated semiconductor components. However, the disadvantage of this is that the safety circuits are configured separately from the actual actuation of the lifting motor. A further disadvantage is that this solution is relatively expensive, because firstly a microcontroller with corresponding programming is required and secondly the safety circuits with associated actuation must be provided.

BRIEF SUMMARY OF THE INVENTION

It is an object of the invention to prevent the aforementioned disadvantages and in particular to specify an efficient and inexpensive solution for operating a retractable ventilation system.

This object is achieved according to the features of the independent claims. Developments of the invention emerge from the dependent claims.

According to one aspect of the present invention, a retractable ventilation system for a household appliance includes a lifting motor for moving the ventilation system in two opposing directions, and a switch controlling movement of the lifting motor, wherein a first actuation of the switch moves the ventilation system in a first of the two directions, and wherein a second actuation of the switch moves the ventilation system in a second direction opposing the first direction.

According to an advantageous feature of the present invention, the switch may be configured as a push-button. For example, a switch impulse can be used to retract or extend the ventilation system (fully), depending on what state the retractable ventilation system is in at the time.

According to an advantageous feature of the present invention, the operation of the retractable ventilation system may be enabled by a single switch. This simplifies operation for a user, who does not have to look for and activate one of several buttons, depending on the actual position. A next action thereby advantageously ensures that when reaching an undefined state, e.g. after activating an obstruction sensor, the ventilation system is moved in the preferred direction.

According to another advantageous feature of the present invention, a microcontroller is not required for operation of the ventilation system, nor any associated software. The implementation can be implemented using passive components, diodes, and switches, e.g. relays.

Advantageously, the ventilation system may be a retractable tabletop ventilation system. The ventilation system may operate similar to an extractor hood, i.e. it can develop a suction effect in a (partially) extended state and extract e.g. vapor or steam. A connection (e.g. a channel, a tube, etc.) from the ventilation system to a location at which the vapor or steam can exit is for example provided for this purpose.

According to another advantageous feature of the present invention, the retractable ventilation system may have at least one retractable suction housing or at least one retractable air intake.

For example, the ventilation system can be integrated in the form of at least one suction housing or at least one air intake into a tabletop or a worktop or an oven and can be extended when required.

According to another advantageous feature of the present invention, the first (or preferred) direction may at least partially include extension of the ventilation system.

This advantageously significantly reduces the risk of injury, e.g. by trapping a hand or a finger, when the ventilation system is extended. Thus the proposed circuit ensures that when an undefined state is reached (e.g. after activation of an obstruction sensor) the ventilation system is initially transferred to the extended state.

According to another advantageous feature of the present invention, the first (or preferred) direction may be selected by a circuit comprising a time-delay circuit.

According to another advantageous feature of the present invention, the time-delay circuit may include an RC element.

The time-delay circuit, which e.g. can use an RC element formed of a resistor and a capacitor, ensures that when two current paths are simultaneously activated via the switch, the same current path can always deactivate the other current path, because the other current path initially charges the capacitor via the resistor (RC element).

In other words, the RC element causes one of two current paths to respond with a delay, so that a defined state can be reached wherein one of two current paths (the one without the time-delay circuit) is always activated first.

According to another advantageous feature of the present invention, the ventilation system may include an electronic switch switching between two current paths for operating the lifting motor, wherein actuation of the switch selects one of two current paths, with the selected current path causing the electronic switch to interrupt the other current path, and at least one limit switch configured to interrupt the selected current path.

As mentioned above, the current path is selected in a defined manner using the time-delay circuit. The limit switch may be an NC contact, in other words a contact which in the basic state is closed and produces an electrical connection. The NC contact can be opened by a mechanical effect, e.g. the movement of the lifting motor or of the ventilation system; in this case the electrical connection to the lifting motor relating to the still active current path is preferably also interrupted.

According to another advantageous feature of the present invention, the electronic switch may be a semiconductor switch or a relay.

The switch may be, for example, a relay. The interruption of the respective other current path ensures that only one current path is active and the other current path is blocked. Thus the ventilation system normally moves (providing nothing is identified as being trapped or no malfunction is present) in a predefined manner.

According to another advantageous feature of the present invention, the ventilation system may include two limit switches which are configured so as to be redundant in respect of one another.

Advantageously, two limit switches may be connected in series, e.g. functionally, to one another for each current path, i.e. the supply of current is also interrupted if one of the two limit switches "sticks", in other words no longer interrupts the contact. For example, the actuation of an electronic switch, e.g. relay, may be effected via a first limit switch such that (e.g. via the two-way switch of this relay) the supply of current to the lifting motor is interrupted. The second limit switch may be disposed in the current path of the lifting motor and the supply of current to the motor is likewise interrupted when the corresponding limit position is reached. Thus it is ensured that the lifting motor stops even if one of the limit switches no longer opens.

According to another advantageous feature of the present invention, the limit switch may include at least one position limit switch per current path.

The position limit switch may be a switch which enables the end of a position, e.g. of the retracted or extended ventilation system, to be identified.

In an alternative embodiment, the limit switch may be activated for the one current path upon reaching the extended position of the retractable ventilation system and the limit switch may be activated for the other current path upon reaching the retracted position of the retractable ventilation system.

According to another aspect of the present invention, a household appliance includes at least one ventilation system as described herein. The household appliance may, for example, be an extractor hood, a cooking appliance or a combination formed of an extractor hood and a cooking appliance. In the latter case of a combination of extractor hood and cooking appliance, extractor hood and cooking appliance may be configured as a combined household appliance having both functions. Alternatively, the extractor hood and the cooking appliance may be formed by separate individual appliances which are directly associated with one another in the region of a cooking zone. Within the meaning of the invention, these two individual appliances can then jointly form one household appliance.

According to another aspect of the present invention, a method for operating a retractable ventilation system includes the steps of moving the ventilation system with a lifting motor in a first of two directions in response to a first actuation of a switch, and moving the ventilation system with the lifting motor in a second direction opposing the first direction in response to a second actuation of the switch.

According to an advantageous feature of the present invention, actuation of the switch selects one of two current paths for operating the lifting motor, and the selected current path causes an electronic switch to interrupt the other current path.

According to another advantageous feature of the present invention, the one of two current paths may be selected by a time-delay circuit.

The above features and advantages relating to the ventilation system or household appliance apply correspondingly for the method.

BRIEF DESCRIPTION OF THE DRAWINGS

Other features and advantages of the present invention will be more readily apparent upon reading the following description of currently preferred exemplified embodiments of the invention with reference to the accompanying drawing, in which:

FIG. 1 shows an exemplary circuit for actuating a retractable tabletop ventilation system, such as a suction housing or an air intake, via a lifting motor.

DETAILED DESCRIPTION OF EXEMPLARY EMBODIMENTS OF THE PRESENT INVENTION

The circuit proposed here for actuating a ventilation system, in particular a retractable tabletop ventilation system (e.g. a suction housing of such a retractable tabletop ventilation system) actuates a lifting motor with a preferred direction, the preferred direction corresponding for example to the extension of the ventilation system (or suction housing), since during extension there is a much lower risk of injury for a user than in the reverse situation when the ventilation system is being retracted. Furthermore, limit switches can be provided for safety-related requests, which restrict the movement of the suction housing or deactivate the lifting motor on reaching a limit position. The limit switch can be a contact which is opened as a function of the position of the suction housing; alternatively the limit switch can be implemented as an electrical contact which is interrupted as soon as the lifting motor can no longer advance the suction housing (for example the suction housing is moved as far as the limit position and the further movement of the lifting motor interrupts the contact). The suction housing is cited here as an example of a movable element of a retractable tabletop ventilation system; other forms of the retractable tabletop ventilation system are also possible and can be moved via the lifting motor, preferably retracted or extended.

The circuit preferably comprises passive components, diodes and relays and dispenses with integrated circuits or microcontrollers.

The lifting motor, and thus the lifting mechanism of the suction housing, is actuated using a push-button, which triggers both the raising and the lowering. The supply voltage is routed via the safety circuits and/or limit switches or via the push-button and subsequently via relays. Depending on the state of the suction housing the actuation of the push-button can trigger a movement of the suction housing in the one or other (counter) direction. For example, a supply voltage with different polarity can be applied to the lifting motor for this purpose (the lifting motor turns in a different direction depending on the polarity of the supply voltage).

The circuit thus ensures that the lifting motor is operated (in other words extends or retracts) only in the correct position of the respective limit switch and upon actuation of the push-button. Likewise, this circuit ensures that following a stop at an undefined position or following an actuation of an obstruction sensor, the lifting motor always moves the suction housing in a preferred direction into a non-critical position (e.g. upward).

Turning now to the drawing, FIG. 1 shows an exemplary circuit for actuating a retractable tabletop ventilation system, e.g. a suction housing, via a lifting motor 101.

The lifting motor 101 is connected on one side to a node 102 and on the other side to a node 103. The node 102 is connected to a node 104 via a diode D1, the cathode of the diode D1 pointing in the direction of the node 104. The node 103 is connected to a node 105 via a diode D2, the cathode of the diode D2 pointing in the direction of the node 105.

The node 104 is connected to a node 107 via an NC contact 106. An NC contact is a contact which is "normally closed"

(NC) and so produces an electrical connection. Accordingly the node 105 is connected to a node 109 via an NC contact 108.

The node 107 is connected to ground GND via the two-way switch of a relay K3, which is connected in series to a relay K1. The node 109 is connected to a node 110 via the two-way switch of a relay K4. The node 110 is connected to ground GND via a relay K2. The node 110 is connected to a node 111 via a series connection comprising a resistor R1 and a diode D5, the cathode of the diode D5 pointing in the direction of the node 111. The node 111 is connected to ground GND via an electrolyte capacitor C1. Furthermore, the node 111 is connected to ground GND via a resistor R2.

A supply voltage 112 (e.g. 24V direct voltage) is connected to a node 113. The node 113 is connected to a node 115 via an NC contact 114. The two-way switch of the relay K2 connects the node 103 either to the node 115 or to ground GND. Furthermore, the node 113 is connected to a node 117 via an NC contact 116. The two-way switch of the relay K1 connects the node 102 either to the node 117 or to ground GND.

The node 102 is connected to ground GND via the relay K4 and the node 103 is connected to ground GND via the relay K3.

The node 113 is connected to a node 118 via a push-button S1, the node 118 being connected to the node 105 via a diode D3. The cathode of the diode D3 here points in the direction of the node 105. Furthermore, the node 118 is connected to the node 104 via a diode D4, the cathode of the diode D4 pointing in the direction of the node 104.

The part of the circuit comprising the resistor R1, the diode D5, the capacitor C1 and the resistor R2 corresponds to a possible implementation for a preferred direction circuit. Preferably the preferred direction corresponds to a movement of the suction housing into the (fully) extended state, e.g. upward.

FIG. 1 shows the associated two-way switches (also designated as K1 to K4 in the circuit diagram) for the relays K1 to K4, the positions of the two-way switches shown in FIG. 1 applying respectively for the inactive relays K1 to K4.

If the push-button S1 is actuated, the current first flows through the path with the relay K1, because the relay K2 is delayed by the preferred direction circuit compared to the relay K1 (i.e. the capacitor C1 is first charged). The lifting motor 101 is activated and the suction housing moves upward. Likewise activated is the relay K4, with the result that the two-way switch to K4 interrupts the connection to the relay K2 (i.e. the nodes 109 and 110 are not connected to one another). The lifting motor 101 thus moves the suction housing upward until the top end is reached, i.e. until the NC contact 106 opens and interrupts the supply of current to the relay K1. Thus the supply of current to the lifting motor 101 is also interrupted via the two-way switch K1. The NC contact 106 is for example implemented as a (position) limit switch.

If the push-button S1 is now actuated again, then because of the suction housing located in the top position and thus open NC contact 106 the current can only flow through the right-hand branch (in other words the relay K2). The suction housing is retracted. Additionally the relay K3 is triggered, as a result of which the associated two-way switch interrupts the connection of the node 107 to the relay K1. This ensures that the suction housing can be fully retracted, even if after leaving the extended limit position the NC contact 106 is closed again. When the suction housing reaches the retracted limit position, the NC contact 108 is opened and the supply of current to the lifting motor 101 is interrupted via the relay K2 with an associated two-way switch. The NC contact 108 too can be implemented as a (position) limit switch.

The NC contact 116 is a redundant contact for the extended (e.g. top) limit position of the suction housing. The redundant arrangement of the NC contacts 106 and 116 means that one of the contacts can be defective (i.e. no longer opens) yet nevertheless the final deactivation works correctly: as long as the suction housing is traveling upward the relay K1 is active and thus the node 117 is connected to the supply voltage 112 (the relay K2 is meanwhile inactive, i.e. the node 103 is at ground GND and is not connected to the node 115). If both NC contacts 106 and 116 are working correctly, the lifting motor 101 is isolated from the supply voltage 112 on reaching the limit position. If one of the two NC contacts 106 and 116 is defective (i.e. does not isolate), it is sufficient that the respective other NC contact 106 or 116 is still working in order to interrupt the circuit for the operation of the lifting motor 101 (in the case of the NC contact 106 indirectly via the relay K1 and in the case of the NC contact 116 directly).

The redundant design of the two NC contacts 108 and 114 works correspondingly when the suction housing is being retracted: if only one of the two NC contacts 108 or 114 opens, the supply of current to the lifting motor 101 is interrupted (in the case of the NC contact 108 indirectly via the relay K2 and in the case of the NC contact 114 directly). During retraction of the suction housing the relay K2 is active and connects the node 103 to the node 115 via its two-way switch. For the reasons mentioned the relay K1 is inactive, i.e. the node 117 is not connected to the node 102.

It is advantageous here that thanks to the proposed circuit neither a microcontroller nor any wiring or programming thereof is necessary. The solution thus aims at a circuit which can be implemented inexpensively and simply and which can be used for different retractable tabletop ventilation systems. It is also advantageous that the circuit enables actuation of the retractable tabletop ventilation system by means of just a single push-button: depending on the state of the retractable tabletop ventilation system this is retracted or extended by the actuation of the push-button.

The invention claimed is:

1. A retractable ventilation system for a household appliance, comprising:

a lifting motor for moving the ventilation system in two opposing directions, and a switch controlling movement of the lifting motor, and an electronic switch switching between two current paths for operating the lifting motor, wherein actuation of the switch selects one of two current paths, with the selected current path causing the electronic switch to interrupt the other current path, and at least one limit switch configured to interrupt the selected current path, wherein a first actuation of the switch moves the ventilation system in a first of the two directions, and wherein a second actuation of the switch moves the ventilation system in a second direction opposing the first direction.

2. The ventilation system of claim 1, wherein the retractable ventilation system comprises at least one retractable suction housing or at least one retractable air intake.

3. The ventilation system of claim 1, wherein the ventilation system is at least partially extended when moving in the first direction.

4. The ventilation system of claim 1, further comprising a time-delay circuit, wherein the first direction is selected by the time-delay circuit.

5. The ventilation system of claim 4, wherein the time-delay circuit comprises an RC element.

6. The ventilation system of claim 1, wherein the electronic switch is a semiconductor switch or a relay.

7. The ventilation system of claim 1, comprising two mutually redundant limit switches.

8. The ventilation system of claim 1, wherein the at least one limit switch comprises at least one position limit switch for each of the two current paths.

9. The ventilation system of claim 1, wherein a first limit switch is activated when the retractable ventilation system reaches an extended position along the first direction and a second limit switch is activated when the retractable ventilation system reaches a retracted position along the second direction.

10. A household appliance, comprising at least one retractable ventilation system having a lifting motor for moving the ventilation system in two opposing directions, and a switch controlling movement of the lifting motor, and an electronic switch switching between two current paths for operating the lifting motor, wherein actuation of the switch selects one of two current paths, with the selected current path causing the electronic switch to interrupt the other current path, and at least one limit switch configured to interrupt the selected current path, wherein a first actuation of the switch moves the ventilation system in a first of the two directions, and wherein a second actuation of the switch moves the ventilation system in a second direction opposing the first direction.

11. The household appliance of claim 10, comprising at least one of an extractor hood and a cooking appliance.

12. The household appliance of claim 10, comprising at least one retractable suction housing or at least one retractable air intake.

13. The household appliance of claim 10, wherein the retractable ventilation system is at least partially extended when moving in the first direction.

14. The household appliance of claim 10, wherein the retractable ventilation system comprises a time-delay circuit, wherein the first direction is selected by the time-delay circuit.

15. The household appliance of claim 14, wherein the time-delay circuit comprises an RC element.

16. The household appliance of claim 10, wherein the electronic switch is a semiconductor switch or a relay.

17. The household appliance of claim 10, wherein the retractable ventilation system comprises two mutually redundant limit switches.

18. The household appliance of claim 10, wherein the at least one limit switch comprises at least one position limit switch for each of the two current paths.

19. The household appliance of claim 10, wherein a first limit switch is activated when the retractable ventilation system reaches an extended position along the first direction and a second limit switch is activated when the retractable ventilation system reaches a retracted position along the second direction.

20. A method for operating a retractable ventilation system, comprising the steps of:

moving the ventilation system with a lifting motor in a first of two directions in response to a first actuation of a switch, and moving the ventilation system with the lifting motor in a second direction opposing the first direction in response to a second actuation of the switch, wherein an electronic switch switching between two current paths for operating the lifting motor, wherein actuation of the switch selects one of two current paths, with the selected current path causing the electronic switch to interrupt the other current path, and at least one limit switch configured to interrupt the selected current path.

21. The method of claim 20, wherein the one of two current paths is selected by a time-delay circuit.

* * * * *